US008256334B2

(12) United States Patent
Lin

(10) Patent No.: US 8,256,334 B2
(45) Date of Patent: Sep. 4, 2012

(54) CUTTING STRUCTURE FOR PLASTIC FILM

(75) Inventor: Chun-Yu Lin, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 376 days.

(21) Appl. No.: 12/765,798

(22) Filed: Apr. 22, 2010

(65) Prior Publication Data

US 2011/0179927 A1 Jul. 28, 2011

(51) Int. Cl.
*B26D 7/28* (2006.01)

(52) U.S. Cl. ..... 83/522.14; 83/522.29; 83/649; 225/17; 225/18; 242/563.2

(58) Field of Classification Search .. 83/522.11–522.14, 83/522.29, 648, 649, 72, 73, 949; 225/6, 225/10–12, 15–18, 39, 77, 91; 242/520–522, 242/526–526.1, 550, 563, 563.2
See application file for complete search history.

(56) References Cited

U.S. PATENT DOCUMENTS 3,175,440 A * 3/1965 Drenning ..... 83/76
3,197,137 A * 7/1965 Watson ..... 235/103.5 R
3,896,691 A * 7/1975 Granger et al. ..... 83/335
3,948,125 A * 4/1976 Hujer et al. ..... 83/62
4,470,555 A * 9/1984 Lawson ..... 242/525.4
4,529,114 A * 7/1985 Casper et al. ..... 225/100
4,809,573 A * 3/1989 Welch ..... 83/37
5,894,978 A * 4/1999 Welch et al. ..... 225/7
6,082,662 A * 7/2000 Gallien ..... 242/588.6
6,607,110 B2 * 8/2003 Nusbaum ..... 225/43
7,395,640 B1 * 7/2008 Wang ..... 53/389.3
2003/0209122 A1 * 11/2003 Nguyen ..... 83/614

* cited by examiner

*Primary Examiner* — Phong Nguyen
(74) *Attorney, Agent, or Firm* — Altis Law Group, Inc.

(57) ABSTRACT

A cutting structure for plastic film includes a bracket, a first roller, a second roller, a tachometer, a processor, a monitor and a cutter. The bracket includes a bottom and two sidewalls extending from the bottom along a same direction. The first roller includes a shaft fixed to the sidewalls and a sleeve rotatably sleeving on the shaft. The second roller is pivotally connected to the sidewalls. The tachometer is disposed on one end of the second roller and configured for measuring the rotation speed of the second roller. The processor is configured for reading the rotation speed and further calculating a rotation distance of the second roller. The monitor is configured for displaying the rotation distance. The cutter extends upward from the bottom for cutting the plastic film pulled from the first roller and the second roller.

13 Claims, 3 Drawing Sheets

CUTTING STRUCTURE FOR PLASTIC FILM

BACKGROUND

1. Technical Field

This present disclosure relates to cutting structures, and particularly, to a cutting structure for plastic film.

2. Description of Related Art

Plastic film is generally used for keeping foods fresh or protecting electrical devices from being contaminated. For convenience, users often unwind the plastic film from a roller so that the plastic film can be pulled out due to a rotation of the roller. However, users cannot effectively and sufficiently control the pulling length of the plastic film, therefore, waste may occur when too much of the plastic film is pulled out.

Therefore, it is desirable to provide a cutting structure for plastic film, which can overcome or at least alleviate the above-mentioned limitations.

DETAILED DESCRIPTION

Figure 1:
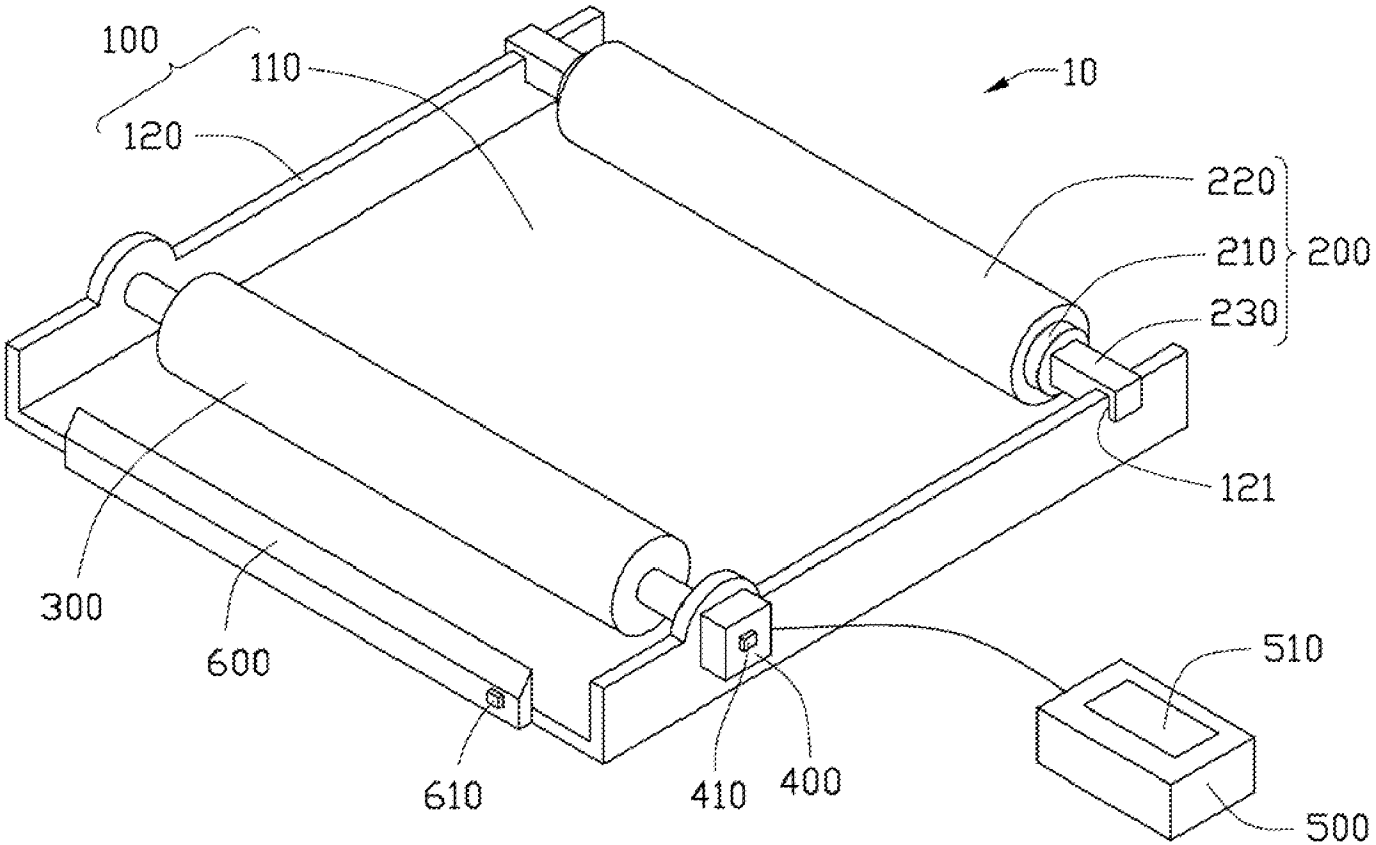
FIG. 1 is a schematic assembled view of a cutting structure for plastic film, according to one exemplary embodiment.
Figure 2:
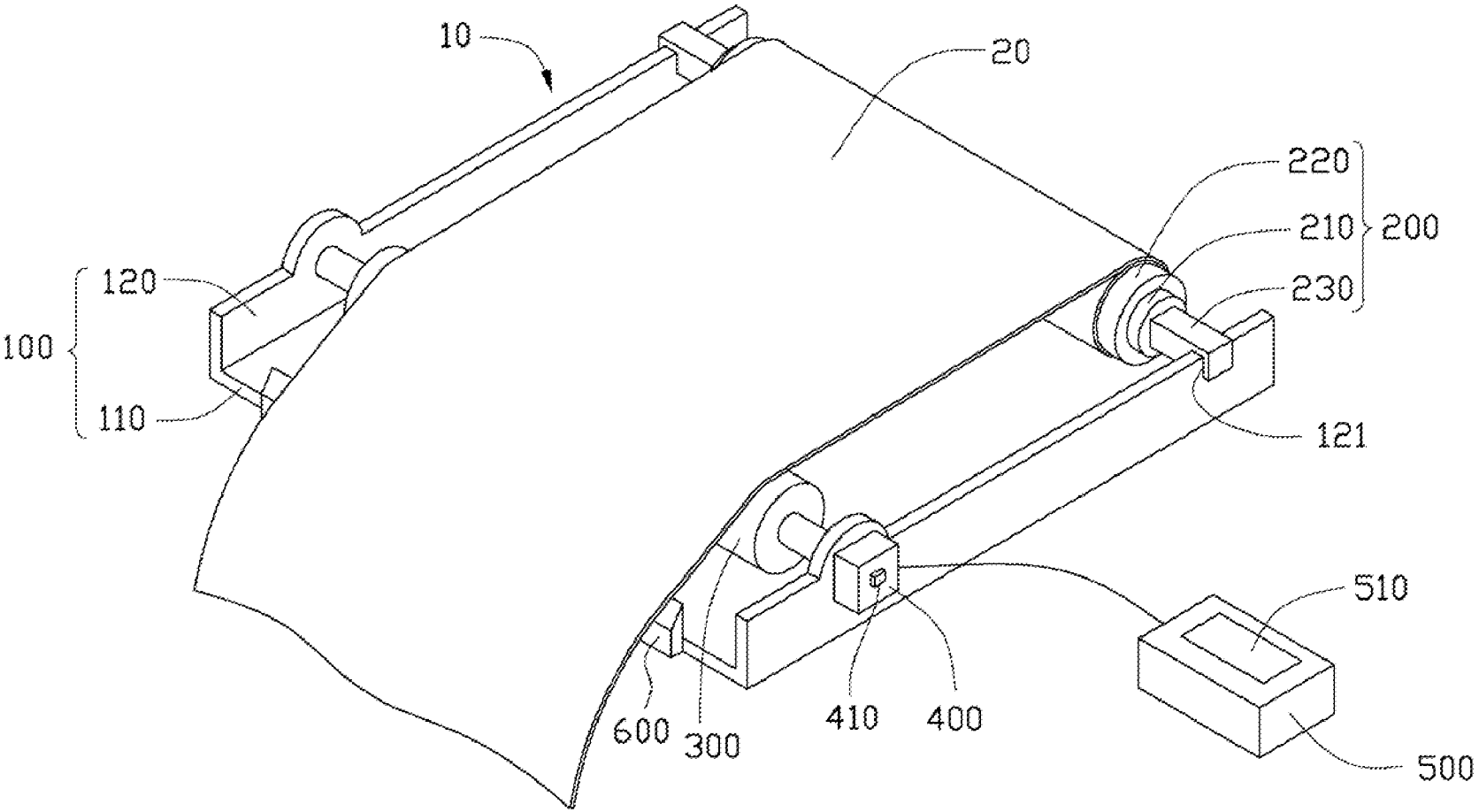
FIG. 2 is a schematic assembled view of the cutting structure of FIG. 1, showing a working state of the cutting structure.

Referring to FIGS. 1 and 2, a cutting structure 10 for plastic film 20 according to a first exemplary embodiment is shown. The cutting structure 10 includes a bracket 100, a first roller 200, a second roller 300, a tachometer 400, a processor 500 and a cutter 600. The first roller 200, the second roller 300 and the cutter 600 are parallelly aligned on the bracket 100.

The bracket 100 includes a bottom 110 and two opposite sidewalls 120 extending from two opposite edges of the bottom 110 correspondingly along a same direction. The sidewalls 120 are substantially perpendicular to the bottom 110. Each sidewall 120 defines a cutout 121 for respectively receiving the ends of the first roller 200. In the present disclosure, the bottom 110 and the cutout 121 both are rectangular.

The first roller 200 is parallel to the bottom 110. The first roller 200 includes a columned shaft 210 and a columned sleeve 220 sleeved on the columned shaft 210. The sleeve 220 can be rotated around the shaft 210 due to a force applied thereon. Two opposite ends of the shaft 210 respectively extend a positioning block 230 received in the cutout 121. The cross-section of the positioning block 230 is rectangular corresponding to the cutout 121.

The second roller 300 is also column-shaped and parallel to the bottom 110. The second roller 300 is pivotably connected to the sidewalls 120 and can rotate relative to the bracket 100.

The tachometer 400 is disposed on one end of the second roller 300 and outside the sidewall 120 of the bracket 100. The tachometer 400 is configured for measuring the rotation speed, e.g., the rotations per minute, of the second roller 300.

The processor 500 is electrically connected to the tachometer 400 and configured for reading the rotations of the tachometer 400 and calculating a rotation distance of the second roller 300. The processor 500 further connects to a monitor 510 for displaying the rotation distance.

The cutter 600 is positioned at an end of the bracket 100 adjacent to the second roller 300. The cutter 600 extends upward from the bottom 110. In the present disclosure, the cutter 600 is integrated with the bottom 110 and substantially perpendicular to the bottom 110. The edge of the cutter 600 includes a sensor 610 for detecting a touching or approaching signal from the plastic film 20, and then activates the tachometer 400 and the processor 500. It is noteworthy that the sensor 610 can be an infrared sensor, a touch sensor, a pressure sensor, or a proximity sensor. In the present disclosure, the sensor 610 is a touch sensor.

It is noteworthy that the tachometer 400 or the processor 500 may further includes a clear button 410 for clearing the rotation distance stored in the tachometer 400 when a cutting is finished. In the present disclosure, the clear button 410 is disposed on an outer surface of the tachometer 400 and the users can easily press on the clear button 410 to restart the tachometer 400 and the processor 500.

Figure 3:
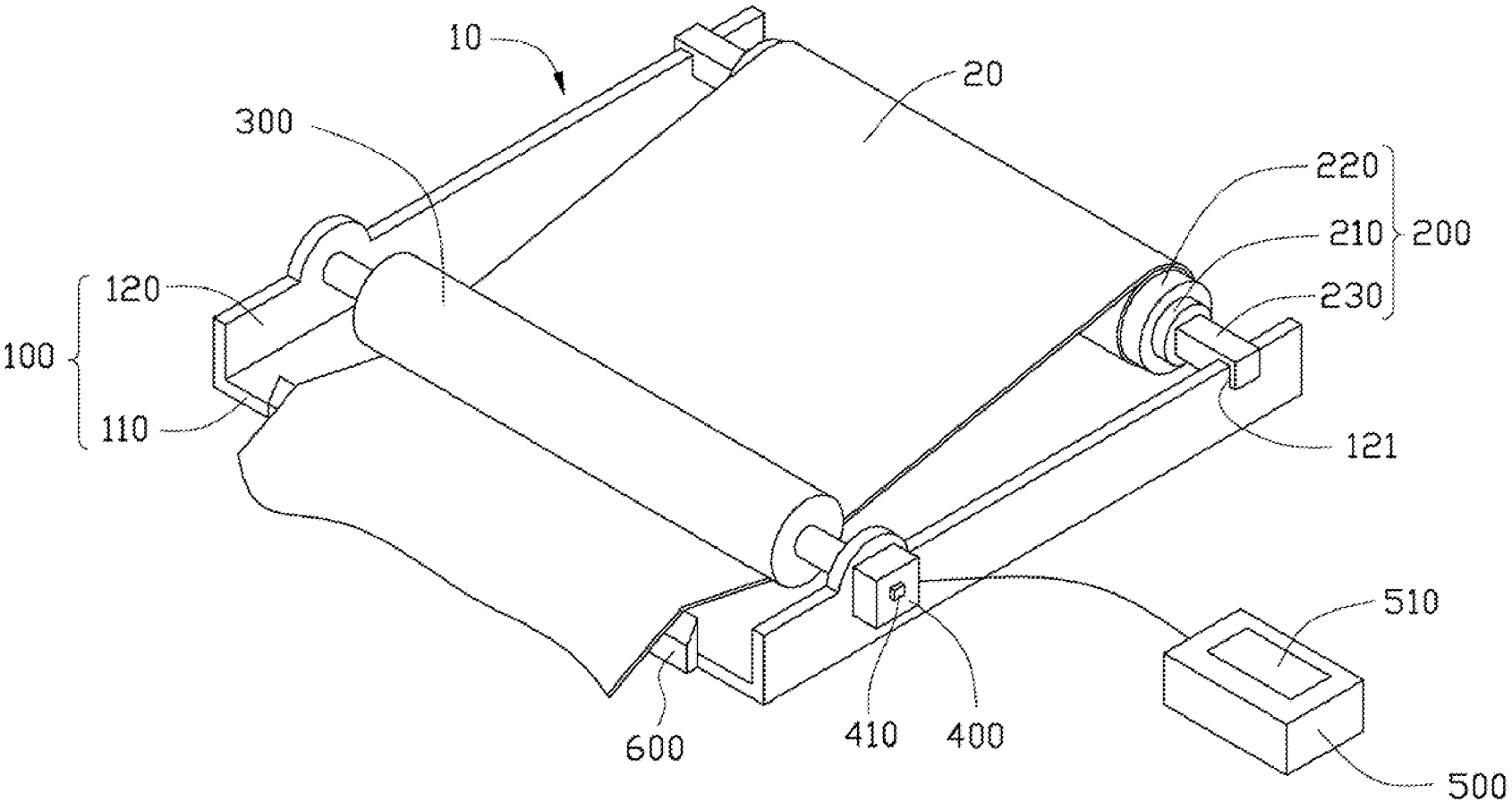
FIG. 3 is similar to FIG. 1, but according to another exemplary embodiment of the cutting structure for plastic film.

Referring to FIG. 3 together with FIG. 2, when in use, the plastic film 20 is wound around the first roller 200. The user pulls the plastic film 20 from the first roller 200 to the second roller 300, until the plastic film 20 passes through the second roller 300 by attaching the top surface of the second roller 300 or under the bottom surface of the second roller 300. As such, the plastic film 20 may rotate the second roller 300 when it is continuously pulled to the edge of the cutter 600. The tachometer 400 is activated to calculate the rotations of the second roller 300 when the plastic film 20 touches or approaches the edge of the cutter 600. The monitor 510 continuously displays the rotation distance of the second roller 300, therefore, the users can effectively and sufficiently cut down an piece of plastic film 20 which is in expected length.

While various exemplary and preferred embodiments have been described, it is to be understood that the disclosure is not limited thereto. To the contrary, various modifications and similar arrangements (as would be apparent to those skilled in the art), are also covered. Therefore, the scope of the appended claims should be accorded the broadest interpretation so as to encompass all such modifications and similar arrangements.

What is claimed is:

1. A cutting structure for plastic film comprising:

a bracket comprising a bottom and two opposite sidewalls extending from the bottom along a same direction;

a first roller comprising a shaft fixed to the sidewalls and a sleeve rotatably sleeved on the shaft, the plastic film being winded around the sleeve;

a second roller pivotably connected to the sidewalls and operable to rotate relative to the bracket;

a tachometer disposed on one end of the second roller and configured for measuring the rotation speed of the second roller;

a processor electrically connected to the tachometer and configured for reading the rotation speed measured by the tachometer and calculating a rotation distance of the second roller;

a monitor connected to the processor and configured for displaying the rotation distance; and a cutter extending upward from the bottom for cutting the plastic film pulled from the first roller and the second roller.

2. The cutting structure of claim 1, wherein the first roller, the second roller and the cutter are parallelly aligned on the bracket.

3. The cutting structure of claim 1, wherein the sidewalls are substantially perpendicular to the bottom.

4. The cutting structure of claim 1, wherein each sidewall defines a cutout on an upper end thereof, two opposite ends of the shaft respectively extend a positioning block received in a corresponding one of the cutouts for positioning the shaft on the bracket.

5. The cutting structure of claim 4, wherein the cutouts and the positioning blocks are rectangular.

6. The cutting structure of claim 1, wherein the tachometer is disposed outside one of the sidewalls of the bracket.

7. The cutting structure of claim 1, wherein the cutter is positioned at an end of the bracket adjacent to the second roller.

8. The cutting structure of claim 1, wherein the cutter is integrated with the bottom and substantially perpendicular to the bottom.

9. The cutting structure of claim 1, wherein the cutter comprises a sensor for detecting a touching or approaching signal from the plastic film and activating the tachometer and the processor accordingly.

10. The cutting structure of claim 9, wherein the sensor is one selected from the group consisting of an infrared sensor, a touch sensor, a pressure sensor and an proximity sensor.

11. The cutting structure of claim 1, wherein either the tachometer or the processor comprises a clear button for clearing the rotation distance stored in the tachometer when a cutting is finished.

12. The cutting structure of claim 11, wherein the clear button is disposed on an outer surface of the tachometer.

13. The cutting structure of claim 1, wherein the plastic film is pulled out from the first roller to the second roller by the plastic film passing through the second roller by attaching the top surface of the second roller or under the bottom surface of the second roller.

* * * * *